US007708659B2

(12) United States Patent
Grace, Jr.

(10) Patent No.: US 7,708,659 B2
(45) Date of Patent: May 4, 2010

(54) FIXED BLADE BROADHEAD

(75) Inventor: Louis Grace, Jr., North Street, MI (US)

(73) Assignee: Grace Engineering Corp., Memphis, MI (US)

( * ) Notice: Subject to any disclaimer, the term of this patent is extended or adjusted under 35 U.S.C. 154(b) by 343 days.

(21) Appl. No.: 11/733,216

(22) Filed: Apr. 10, 2007

(65) Prior Publication Data

US 2007/0243959 A1 Oct. 18, 2007

Related U.S. Application Data

(60) Provisional application No. 60/792,690, filed on Apr. 18, 2006.

(51) Int. Cl.
*F42B 6/08* (2006.01)

(52) U.S. Cl. ..... 473/584

(58) Field of Classification Search ..... 473/583, 473/584

See application file for complete search history.

(56) References Cited

U.S. PATENT DOCUMENTS

| | | | | |
|---|---|---|---|---|
| 2,940,758 | A * | 6/1960 | Richter | 473/584 |
| 4,676,512 | A | 6/1987 | Simo | |
| 5,145,186 | A | 9/1992 | Maleski | |
| 5,192,081 | A | 3/1993 | Cooper | |
| 5,354,068 | A | 10/1994 | Maleski | |
| 5,482,293 | A | 1/1996 | Lekavich | |
| 5,494,298 | A | 2/1996 | Maleski | |
| D385,327 | S | 10/1997 | Delmonte | |
| 5,871,410 | A | 2/1999 | Simo et al. | |
| 6,077,180 | A | 6/2000 | Adams, Jr. | |
| 6,428,433 | B1 * | 8/2002 | Liechty, II | 473/583 |
| 6,626,776 | B2 | 9/2003 | Barrie et al. | |
| 6,749,801 | B1 | 6/2004 | Grace, Jr. et al. | |
| 6,866,600 | B1 * | 3/2005 | Johnson | 473/583 |
| 6,942,588 | B2 * | 9/2005 | Barrie | 473/584 |
| 7,182,706 | B2 * | 2/2007 | Barrie | 473/584 |
| 2002/0151394 | A1 * | 10/2002 | Arasmith | 473/583 |
| 2005/0059516 | A1 | 3/2005 | Davis | |

* cited by examiner

*Primary Examiner*—John Ricci
(74) *Attorney, Agent, or Firm*—Warner Norcross & Judd LLP

(57) ABSTRACT

An archery broadhead including a ferrule and at least one replaceable blade, each including interlocking features that securely lock at least the forward portion of the blade to the ferrule. The ferrule defines a blade slot bounded by a land and an inclined surface overhanging a portion of the land. The land and inclined surface form a locking pocket. The blade includes a cutting edge and a locking member. When the broadhead is secured to an arrow, the locking member wedges within the locking pocket to secure the forward portion of the blade to the ferrule. A method is provided including: metal injection molding a ferrule to define a locking pocket, sintering the ferrule, and joining a blade including an locking member with the ferrule so that the locking member wedges within the ferrule locking pocket.

15 Claims, 5 Drawing Sheets

FIXED BLADE BROADHEAD

This application claims benefit of U.S. provisional patent application 60/792,690 filed Apr. 18, 2006, which is hereby incorporated by reference.

BACKGROUND OF THE INVENTION

The present invention relates to archery arrow broadheads, and more particularly to fixed blade broadheads including replaceable blades and a related method of manufacture.

When used to hunt game, archery arrows usually are tipped with broadheads having cutting blades designed to maximize penetration and cutting of tissue, which quickly and humanely harvests the game. A variety of broadheads are available, one of which is a fixed blade broadhead including blades that can be manually replaced if dulled or damaged during use.

Most fixed blade broadheads include a ferrule, a separate and replaceable sharpened tip, and separate and replaceable sharpened blades secured to the ferrule. In such broadhead constructions, the blades are usually triangular, with the forward and rearward portion both secured to the ferrule. Usually, the rearward portion of the blade includes a projecting tang. A ring slides over a rear portion of the ferrule and encircles the tang to secure the rearward portion of the blade to the ferrule.

Securing a rearward portion of a broadhead blade to a ferrule is generally considered an easier task than securing the forward portion of a blade to the ferrule. Broadhead manufacturers have used several different constructions for this forward securement.

One such construction is disclosed in U.S. Pat. No. 5,482,293 to Lekavich. Lekavich discloses a plastic ferrule, a replaceable blade positioned within lands defined by the plastic ferrule, and a metal injection molded tip. The tip includes a 45° rear inclined surface which engages the cutting edges of the blades. Lekavich requires that the ferrule must be plastic and deformable so that when the broadhead is installed on an arrow, the forward portions of the blades are driven down into the plastic lands, necessarily deforming the lands. Although this construction can secure the forward portion of the blade, the integrity of the ferrule is compromised due to the plastic deformation. Furthermore, if the blades are bent in use, this can tear or destroy the plastic lands of the ferrule. Thus, the broadhead is rendered a "one use" broadhead, which defeats the purpose of including replaceable blades.

Another broadhead construction that secures forward portions of replaceable blades is disclosed in U.S. Patent Publication 2005/0059516 to Davis and is offered under the Wac'Em™ trade name. In the Davis construction, a forward portion of a blade forms an unsharpened, block-shaped tang. The ferrule of the Davis construction defines a complimentarily block-shaped retaining notch. This retaining notch is machined into the ferrule, that is, the ferrule material must be removed from the ferrule to define this block-shaped retaining notch. Although the Davis construction provides another way to secure the forward portion of the blade, it requires drilling or grinding away of the ferrule. In many cases, this is time consuming and wasteful of the ferrule material. In addition, additional care must be taken to ensure that excess heat is controlled so that the ferrule material is not weakened around the notch.

Conventional broadheads provide several ways to secure replaceable fixed blades; however, room exists for improvement.

SUMMARY OF THE INVENTION

The aforementioned problems are overcome in the present invention, which provides a broadhead including at least one replaceable blade and a ferrule, each of which include interlocking features to securely lock at least the forward portion of the blade to the ferrule.

In one embodiment, the broadhead includes a ferrule defining a blade slot that is bounded by a non-deformable metal land and a non-deformable metal inclined surface overhanging a portion of the metal land. A blade including a cutting edge and a slot engagement surface is positioned in the blade slot. The blade slot engagement surface is wedged against the blade slot inclined surface when the broadhead is installed on the arrow shaft by a user to securely trap the blade within the blade slot.

In another embodiment, the blade cutting edge terminates short of a forward portion of the blade, and the slot engagement surface is inclined relative to a land edge of the blade. The slot engagement surface of the blade directly engages a metal inclined surface overhanging a portion of the metal land.

In yet another embodiment, the forward portion of the blade forms a substantially triangular locking member, and the slot is formed with a substantially triangular forward portion of the blade slot. The blade locking member wedges within the slot triangular forward portion to secure the blade to the ferrule.

In a further embodiment, a blade slot land is constructed from a non-deformable metal material. Optionally, the ferrule can be constructed as a monolithic metal construction.

In yet another embodiment, a method is provided that includes: metal injection molding at least a ferrule defining a blade slot that is bounded by a land and an inclined surface, the inclined surface overhanging a portion of the land; sintering the ferrule; and joining a blade with the ferrule, the blade including a cutting edge coupled to a land edge in a forward portion of the blade. The forward portion of the blade wedges between the land and the inclined surface of the blade slot. Optionally, this wedging action is performed without deforming the land or the inclined surface of the slot.

In yet a further embodiment, the metal injection molding step includes forming the forward portion of the slot in a substantially triangular configuration. Optionally, the forward portion of the blade can also include a substantially triangular locking member that corresponds with the forward portion of the slot. The blade itself can be configured so that the cutting edge terminates short of the substantially triangular locking member and abuts against a portion of the inclined surface when the blade is joined with the ferrule. Further optionally, other components, such as the blade and/or the interlocking features may be formed via metal injection molding and/or powder injection molding. Other casting processes, such as die-casting, investment casting, thixotropic molding or injection molding, may be used to form the ferrule, the blade and the interlocking features of the broadhead of the present invention as desired.

The present invention provides a simple and easy way to manufacture broadheads including a ferrule and replaceable blades that securely lock to the ferrule. The resulting broadhead includes a rugged and sturdy blade locking system. Due to the locking features, the blades are quickly and easily replaced with minimal effort. Further, when the blade components are metal injection molded or powder injection molded, material can be conserved, and manufacturing time significantly reduced.

These and other objects, advantages and features of the invention will be more readily understood and appreciated by reference to the detailed description of the invention and the drawings.

DETAILED DESCRIPTION OF THE INVENTION

I. Construction and Components

Figure 1:
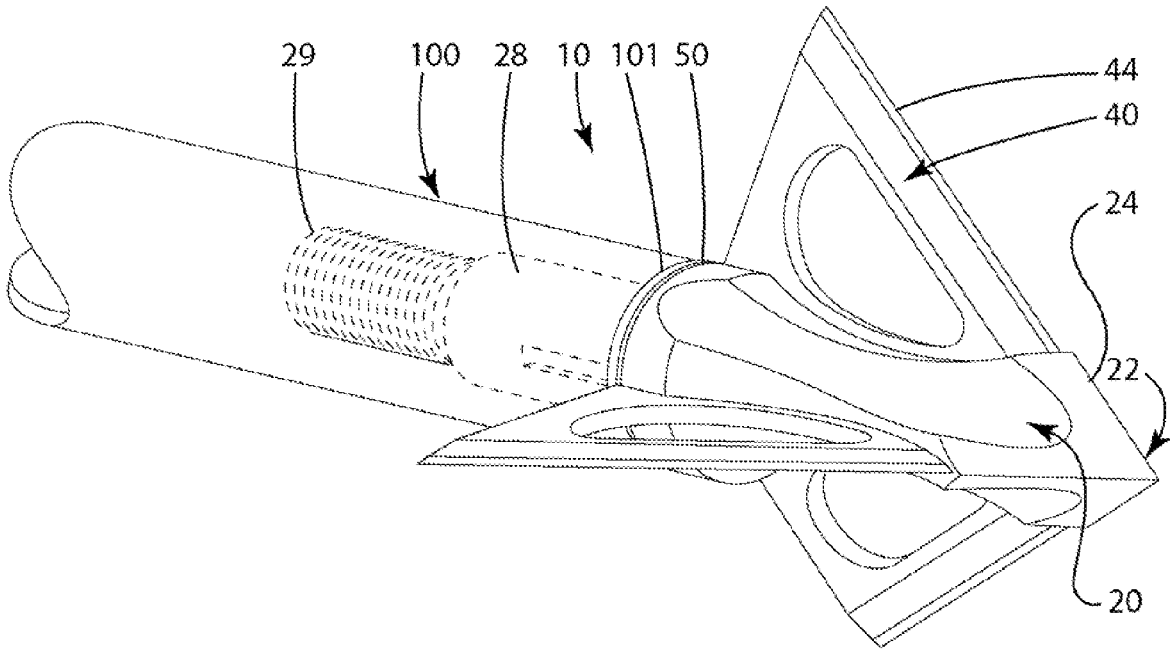
FIG. 1 is a perspective view of a first embodiment of the broadhead installed on an arrow.

A broadhead constructed in accordance with an embodiment of the invention is illustrated in FIGS. 1-6 and generally designated 10. The broadhead 10 generally includes a ferrule 20 that defines an interlocking pocket 32, and a blade including a locking member 42. The locking member 42 can be wedged into the pocket 32 of the ferrule 20 when the broadhead 10 is installed on an arrow shaft 100. An optional retaining member 50 can be disposed adjacent the rearward portion of the blade. For purposes of a disclosure, the broadhead is described in connection with use on an archery arrow; however, the broadhead is well suited for use with any projectile shooting device.

Figure 2:
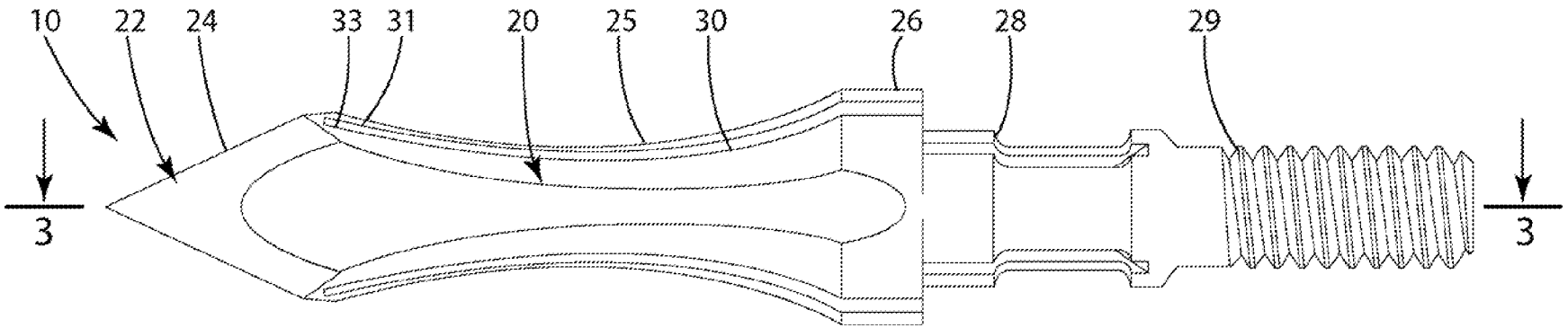
FIG. 2 is a side view of a ferrule of the broadhead.
Figure 3:
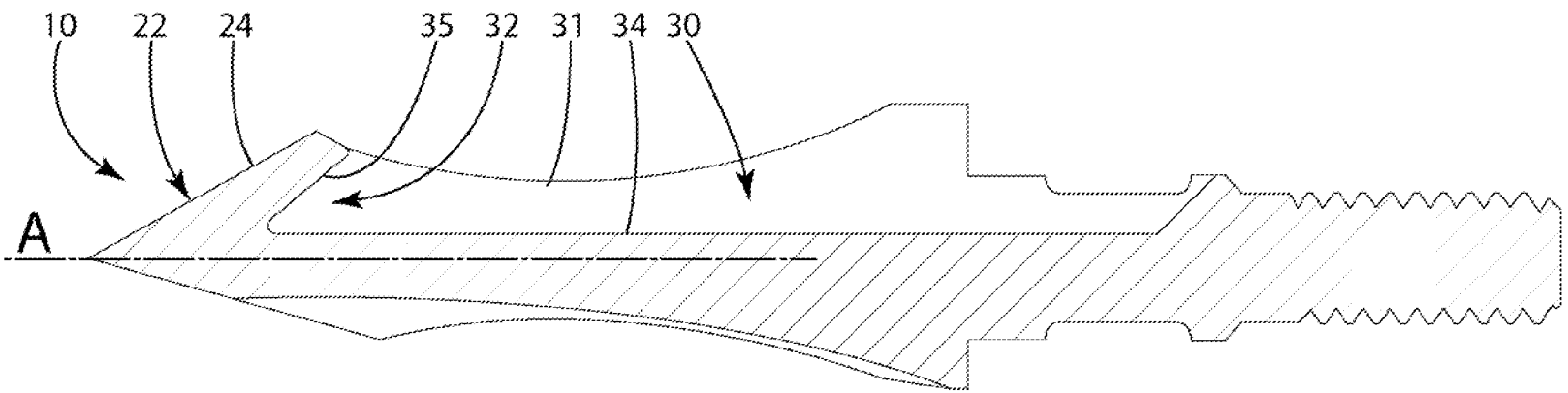
FIG. 3 is a cross-sectional view of the ferrule taken along lines 3-3 of FIG. 2.
Figure 6:
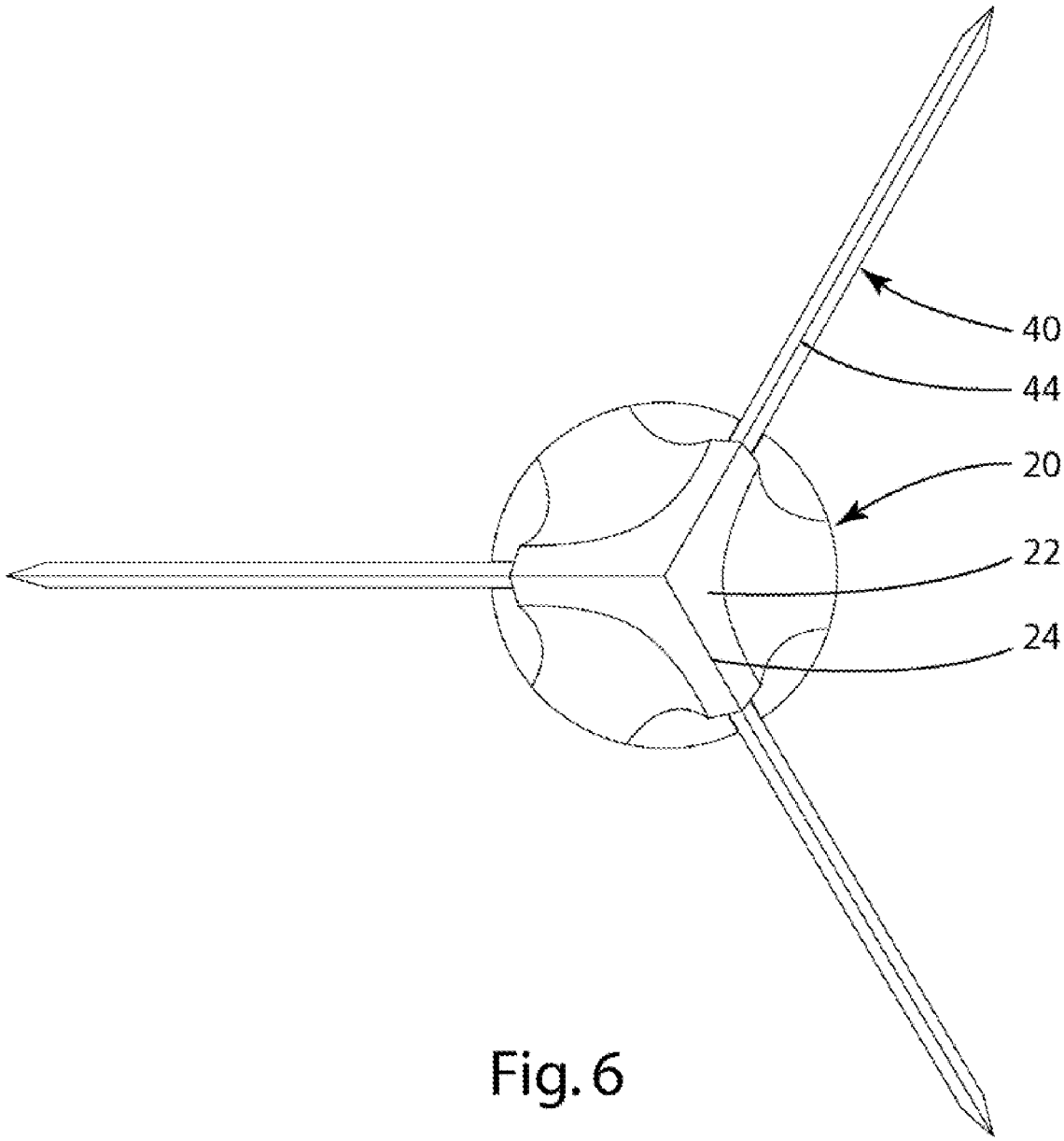
FIG. 6 is a front view of the broadhead with multiple blades installed therein.

With reference to the figures, the components of the broadhead will now be described in further detail. Referring specifically to FIGS. 2-3 and 6, the forward most portion of the ferrule 20 includes a trocar tip 22 having multiple integral blades 24. The number and configuration of these cutting edges 24 can vary as the application requires. The integral blades are aligned substantially in parallel with the blade cutting edges 44 of the corresponding blades 40. However, the integral blades of the trocar tip are offset a distance above or below the blade cutting edge 44 when viewed from the side of the broadhead. The trocar tip 22 transitions to curved indentations 25 defined by the ferrule. Rearward of the curved indentation portions 25, the ferrule 20 includes a shoulder 26. Rearward of the shoulder 26, the ferrule is reduced in cross section and forms a generally cylindrical portion 28. The rearward portion of the cylindrical portion 28 can define threads 29. These threads can be scaled and pitched to fit corresponding threaded bores of an archery arrow insert 101 and/or other threaded apertures. As will be appreciated, other fastening structures can be readily substituted for the threads 29.

In the embodiment shown, the ferrule 20 is monolithic structure. Therefore, all components and structures associated with the ferrule can be integral with the ferrule and contiguous with other components of the ferrule. As will be discussed below, this monolithic configuration can be achieved via metal injection molding, powder injection molding or by other casting processes.

Referring further to FIGS. 2-3, the ferrule 20 defines a blade slot 30. As used herein, the term slot can also refer to a groove, a recess, an aperture, an indentation, and a hole defined by the ferrule. The blade slot 30 can be defined from a forward portion of the ferrule 20, near the trocar tip 22, to the rearward portion of the ferrule, nearing the threads 29. The exact location of blade slot can be modified as the application requires. In the embodiment shown, the blade slot includes opposing slot sidewalls 31 and 33. Again, where the ferrule is monolithic and constructed from metal, the sidewalls accordingly will be constructed from metal. Generally, the sidewalls can extend the entire length of the blade slot from front to rear of the ferrule 20.

Figure 4:
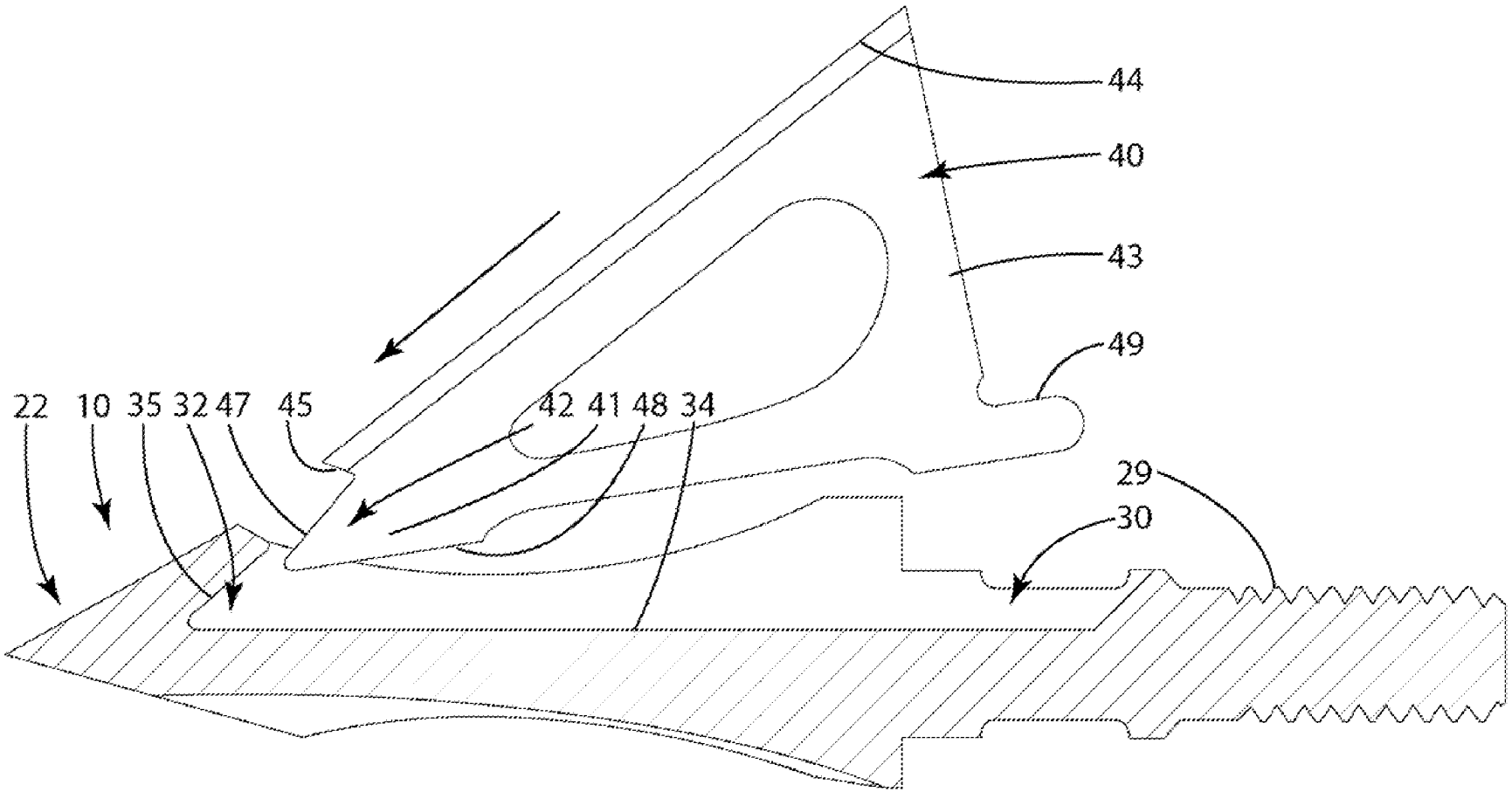
FIG. 4 is a side sectional view of the ferrule of the broadhead with an exemplary blade being inserted into a blade slot of the ferrule.
Figure 5:
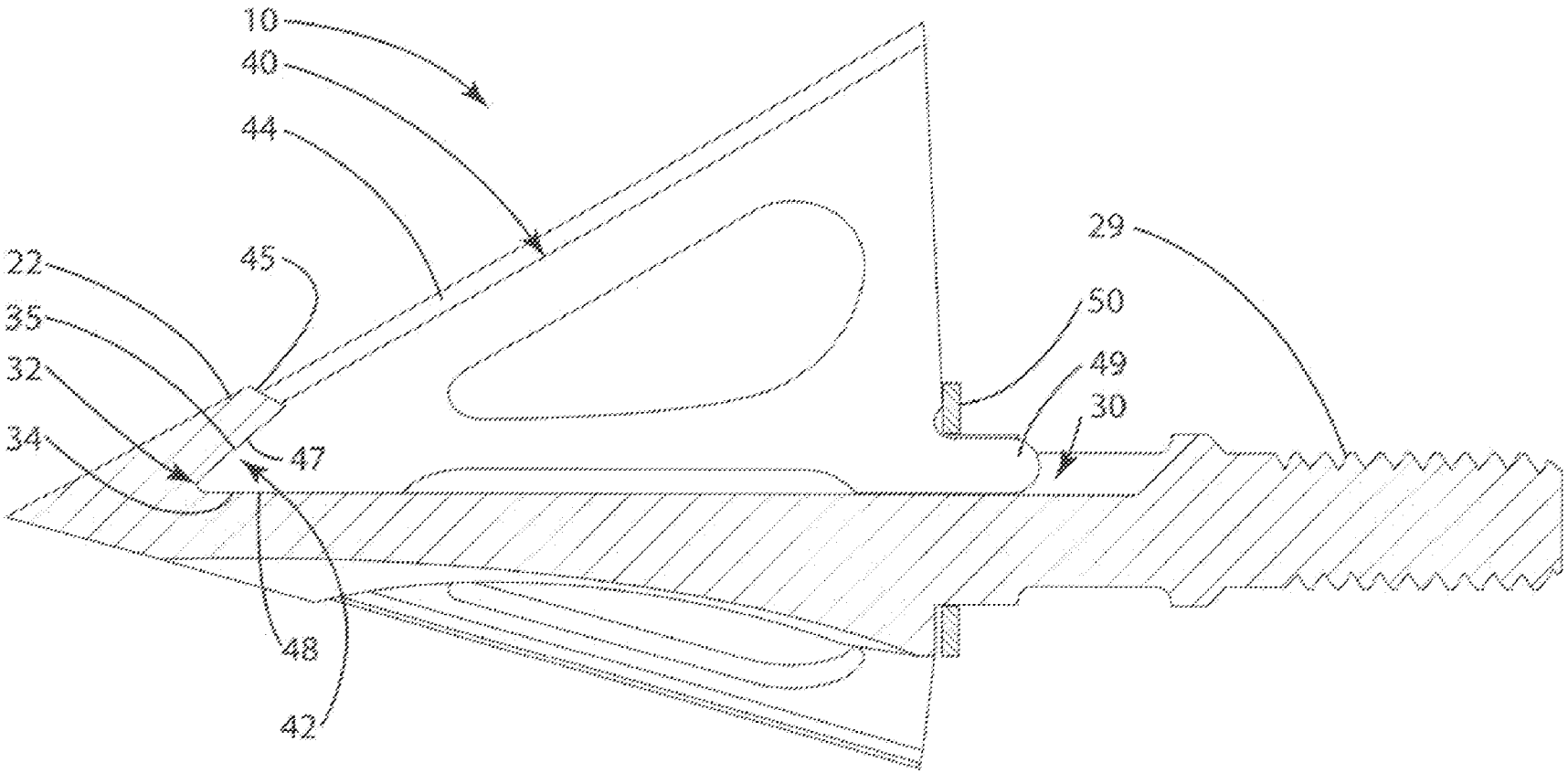
FIG. 5 is a sectional view of a blade installed in the blade slot of the ferrule.

The blade slot 30, shown in FIGS. 4 and 5, can further be bounded by a land 34. As desired, the land can include undulations or surface contours corresponding to features of the blade, further interlocking the blade with the land 34 as the application requires. Optionally, the land 34 can be uninterrupted by any surface undulations contours or projections as it transitions from the triangular shaped pocket 32 toward the rearward most portion of the blade slot 30. For example, the land can be substantially linear and aligned in parallel with the longitudinal axis A of the ferrule 20. The land 34 can transition to a contiguous inclined surface 35, which overhangs at least a portion of the land 34. The inclined surface 35 and the land 34 can cooperate to form a locking recess or pocket 32 generally in the shape of a triangle in the forward portion of the slot 30. The angle of the inclined surface relative to the longitudinal axis A of the ferrule 20 and/or the land 34 can be about 15° to about 60°, optionally about 35° to about 50°, and further optionally about 45°. At the location where the inclined surface 35 and the land 34 transition, also referred to as the forward most portion of the slot, the slot structure can be pointed, rounded and/or angled relative to the land.

The monolithic ferrule 20 can be constructed entirely from metal. Optionally, this metal is substantially rigid and non-deformable. Accordingly, the land 34 and inclined surface 35 can be non-deformable so that when the blade 40 is installed in the blade slot 30 and wedged against and engages these two components of the blade slot 30, these components do not deform. Slight scratching and/or marring of these components is not considered deforming.

With reference to FIGS. 4 and 5, the blade 40 of the broadhead 10 includes a forward portion 41 and a rearward portion 43. In addition, the blade defines a blade cutting edge 44 coupled to a blade land edge 48 and a blade rear edge. The blade further includes opposing blade sides and defines a recess or aperture as desired. The rearward portion of the blade 43 can include an optional tang or tab 49 of any desired configuration. This tab 49 can be captured by an optional retaining member 50. As shown, that retaining member is generally an annular or ringed shaped element that fits over a portion of the tab 49 when the blade is disposed in the slot 30.

At the forward portion 41 of the blade 40, the blade includes a locking member 42. This locking member is generally substantially triangularly shaped. Of course, the forward most portion of this locking member 42 can be pointed, rounded or cut off at an angle relative to the land edge 48 as desired. Optionally, the forward portion of the blade includes a slot engagement surface 47 that is inclined relative to the land edge. The angle of inclination of this slot engagement surface 47 can be similar to that described above in connection with the inclined surface 35. Indeed, the locking member 42 can be correspondingly shaped and include the same dimensions as the locking pocket 32.

As shown in FIG. 5, the cutting edge 44 can terminate short of the forward portion 41 of the blade, specifically the cutting edge 44 can transition at a notch 45 to the forward portion.

The forward portion can be offset a distance below or above the uppermost portion of the cutting edge 44.

When the blade 40 is installed in the blade slot 30, the forward portion 41 of the blade is trapped in the ferrule 20 via the locking member 42 engaging the pocket 32. Specifically, when the ferrule is installed on an arrow and threaded or otherwise tightened relative to the arrow 100 or arrow insert 101, the blade 40 is pressed forward so that the locking member 42 wedges within the pocket 32. More specifically, the slot engaging surface 47 frictionally engages the inclined surface 35 of the blade slot 30. Likewise, the land edge 48 frictionally engages the land 34 of the blade slot 30. Again, where the ferrule 20 is constructed from an non-deformable material, this engagement does not cause deformation of the inclined surface 35 or the land 34.

As shown in FIG. 5, the notch 45 can engage a portion of the trocar tip 22 adjacent the inclined surface 35 overhanging the blade slot 30. In one embodiment, this engagement does not occur until after the triangular locking member 42 is fully wedged within the pocket 32 to frictionally secure the forward portion of the blade 41 within the blade slot 30.

II. Method of Manufacture

A method of making a broadhead 10 will now be described. This method includes manufacturing the ferrule, and optionally the replacement blades from a metal, such as a steel alloy, using a metal injection molding ("MIM") or powder injection molding ("PIM") process. Features of the ferrule such as the blade slot 30 defining the interlocking pocket 32, can be formed in a finished manner using the MIM or PIM process.

In general, the metal injection molding process includes injection molding a mixture of powdered metal and binder into a mold configured in the shape of the ferrule. The ferrule mold can define a blade slot, the blade slot being bounded by a land and an inclined surface that overhangs a portion of the land as described above. It will be appreciated the other features of the broadhead described above can be included in the ferrule mold as desired.

After the ferrule is metal injection molded, it undergoes a debinding step and a subsequent sintering operation, which is a form of heat treatment that bonds the particles and increases the density and strength of the finished ferrule. A more detailed description of the MIM process and the formation of broadhead components such as ferrules and blades is included in U.S. Pat. No. 6,749,801 to Louis Grace, Jr. et al, which is hereby incorporated by reference, and U.S. Pat. No. 6,290,903 to Louis Grace, Jr. et al, which is also incorporated by reference.

With the ferrule metal injected molded or otherwise formed, the blade 40 is joined with the ferrule. As shown in FIGS. 3, 4 and 5, the blade 40 is inserted into the blade slot 30 so that the land edge 48 engages the land 34. In addition, the slot engagement surface 47 engages the inclined surface 35 of the ferrule 20. Generally, the locking member 42 is inserted within the interlocking pocket 32 of the blade slot. Where the notch 45 is included, the notch may engage the rearward portion of a trocar tip 22.

With the blade installed in the blade slot 30, the annular member 50 is positioned over the tab 49 of the blade to secure the rearward portion of the blade 43. The broadhead can be installed on an arrow by a user. As the broadhead is threaded into the arrow 100, the arrow insert 101 and/or the arrow and/or the retaining member 50 engages the blade 40 thereby urging the blade forward while drawing the ferrule 20 into the arrow insert or arrow shaft. Accordingly, the locking member 42 is lockingly wedged within the pocket 32 of the ferrule. By way of this wedging action, the forward portion of the blade frictionally engages the inclined surface 35 and the land 34, and traps the forward portion of the blade within the blade slot of the ferrule. Where the ferrule 20 is constructed from metal, the components of the blade 40 may scratch or slightly mar the blade slot, namely the land 34 and the inclined surface 35.

Optionally, the monolithic ferrule 20 and the blades 40 can be manufactured using other processes. For example, where the ferrule is manufactured from a light metal alloy, it can alternatively be formed via a casting process such as die-casting, investment casting or thixotropic molding.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are define as follows:

1. An archery broadhead comprising:

a blade including a blade cutting edge coupled to a blade land edge and opposing blade sides, the blade including a forward portion and a rearward portion, the forward portion forming a substantially triangular locking member;

an elongated monolithic ferrule constructed substantially entirely from metal, the ferrule including an integral tip having an integral blade, the ferrule defining a blade slot bounded by a non-deformable land, which is adapted to rigidly engage the blade land edge, and an inclined surface overhanging at least a portion of the land, the land and the inclined surface being substantially contiguous and forming a substantially triangular forward portion of the slot, the forward portion of the slot further bounded by opposing metal slot walls that are adjacent the opposing blade sides when the blade is installed in the blade slot; and a retaining member joined with the ferrule adjacent the rearward portion of the blade, the retaining member wedging the substantially triangular locking member into the substantially triangular forward portion of the blade slot so that the forward portion of the blade is securely locked in the blade slot of the monolithic ferrule when the broadhead is installed on an arrow by a user, wherein the blade cutting edge is offset a distance at least one of above and below the integral blade of the tip when viewed from a side of the ferrule.

2. The archery broadhead of claim 1 wherein the rearward portion of the blade includes a tab, wherein the retaining member is an annular ring, and wherein the annular ring traps the tab when the broadhead is installed on an arrow by a user.

3. The archery broadhead of claim 1 wherein the blade cutting edge projects forwardly over at least a portion of the inclined surface.

4. The archery broadhead of claim 1 wherein the substantially triangular locking member includes a forward-most portion that is at least one of pointed, rounded and angled relative to the land edge of the blade.

5. The archery broadhead of claim 1 wherein the substantially triangular forward portion of the blade slot transitions to the land, and the land extends rearwardly along a substantially straight line aligned with a longitudinal axis of the ferrule.

6. An archery broadhead comprising:

a blade including a blade cutting edge coupled to a blade land edge and opposing blade sides, the blade including a forward portion and a rearward portion, the forward portion forming a substantially triangular locking member;

an elongated monolithic ferrule constructed substantially entirely from metal, the ferrule including an integral tip having an integral blade, the ferrule defining a blade slot bounded by a non-deformable land, which is adapted to rigidly engage the blade land edge, and an inclined surface overhanging at least a portion of the land, the land and the inclined surface being substantially contiguous and forming a substantially triangular forward portion of the slot, the forward portion of the slot further bounded by opposing metal slot walls that are adjacent the opposing blade sides when the blade is installed in the blade slot; and a retaining member joined with the ferrule adjacent the rearward portion of the blade, the retaining member wedging the substantially triangular locking member into the substantially triangular forward portion of the blade slot so that the forward portion of the blade is securely locked in the blade slot of the monolithic ferrule when the broadhead is installed on an arrow by a user, wherein the integral blade of the tip is aligned substantially parallel with the blade cutting edge when the blade is installed on the ferrule, but wherein the integral blade of the tip is offset a distance above or below the blade cutting edge when viewed from a side of the ferrule.

7. An archery broadhead comprising:

a blade including a cutting edge coupled to a land edge, and a substantially triangular locking member located at a forward portion of the blade, the cutting edge terminating short of the locking member; and a monolithic metal ferrule defining a blade slot, the blade slot including a substantially triangular forward portion bounded by a non-deformable land and an integral overhang, the ferrule including an integral tip having an integral tip blade, wherein the substantially triangular locking member is lockingly wedged within the blade slot substantially triangular forward portion when the broadhead is installed on an arrow shaft by a user, wherein the cutting edge of the blade is adjacent said integral tip blade, but offset a distance at least one of above and below the integral tip blade when viewed from the side of the ferrule.

8. The archery broadhead of claim 7 wherein the cutting edge transitions at a notch to the locking member, the notch and the locking member forming a "Z" shape, with the land edge forming a bottom leg of the "Z" shape.

9. The archery broadhead of claim 8 wherein the notch engages an overhang of the ferrule.

10. The archery broadhead of claim 9 wherein the ferrule includes a tip which defines a plurality of integral blades.

11. An archery broadhead comprising:

a monolithic ferrule defining a blade slot, the blade slot bounded by a non-deformable metal land contiguous and integral with a non-deformable metal inclined surface that overhangs a portion of the metal land;

a blade including a cutting edge coupled to a land edge and a forward portion of the blade, the cutting edge terminating short of the forward portion of the blade, the forward portion of the blade including a slot engagement surface that is inclined relative to the land edge, the blade being positioned in the blade slot; and a retaining member lockingly wedging the blade slot engagement surface against the metal inclined surface, and the blade land edge against the non-deformable metal land, whereby the blade is securely trapped within the blade slot of the ferrule, wherein the cutting edge of the blade projects forwardly over at least a portion of the inclined surface.

12. The archery broadhead of claim 11 wherein the blade slot is further bounded by opposing metal blade slot sides, wherein those metal blade slot sides are adjacent the forward portion of the blade and the land edge when the blade is trapped within the blade slot of the ferrule.

13. The archery broadhead of claim 11 wherein the forward portion of the blade is offset a distance that is at least one of above and below the cutting edge of the blade.

14. The archery broadhead of claim 11 including a notch in the blade, wherein the slot engagement surface and land edge form a periphery of a substantially triangular locking member in the forward portion of the blade such that the land edge, the slot engagement surface, and the notch form a "Z" shape.

15. The archery broadhead of claim 11 wherein the land edge extends substantially only linearly rearward from the forward portion of the blade.

* * * * *